US009475667B2

(12) United States Patent
Kodama

(10) Patent No.: US 9,475,667 B2
(45) Date of Patent: Oct. 25, 2016

(54) RECORDING APPARATUS

(71) Applicant: SEIKO EPSON CORPORATION, Tokyo (JP)

(72) Inventor: Hidetoshi Kodama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 37 days.

(21) Appl. No.: 14/665,426

(22) Filed: Mar. 23, 2015

(65) Prior Publication Data

US 2015/0274477 A1 Oct. 1, 2015

(30) Foreign Application Priority Data

Mar. 27, 2014 (JP) ..... 2014-065576

(51) Int. Cl.
*B65H 39/10* (2006.01)
*B65H 29/58* (2006.01)
(Continued)

(52) U.S. Cl.
CPC ..... *B65H 29/58* (2013.01); *B41J 3/60* (2013.01); *B41J 13/0045* (2013.01); *B65H 5/062* (2013.01); *B65H 5/068* (2013.01); *B65H 5/26* (2013.01); *B65H 5/36* (2013.01); *B65H 29/125* (2013.01); *B65H 29/14* (2013.01); *B65H 29/60* (2013.01); *B65H 85/00* (2013.01); *B65H 2301/3122* (2013.01); *B65H 2301/33312* (2013.01); *B65H 2301/51256* (2013.01); *B65H 2402/441* (2013.01); *B65H 2404/1115* (2013.01); *B65H 2404/1416* (2013.01); *B65H 2404/54* (2013.01); *B65H 2404/63* (2013.01); *B65H 2511/415* (2013.01); *B65H 2513/514* (2013.01); *B65H 2601/11* (2013.01); *B65H 2801/06* (2013.01); *B65H 2801/15* (2013.01)

(58) Field of Classification Search
CPC ..... B65H 5/26; B65H 5/062; B65H 5/068; B65H 5/36; B65H 15/00; B65H 29/58; B65H 29/60; B65H 29/2301; B65H 29/333; B65H 29/3331; B65H 29/33312; B65H 85/00; B65H 2404/63; B65H 2402/441; B41J 3/60; B41J 13/0045
See application file for complete search history.

(56) References Cited

U.S. PATENT DOCUMENTS 7,997,676 B2 8/2011 Kawamata et al.
8,205,956 B2 6/2012 Kawamata et al.
(Continued)

FOREIGN PATENT DOCUMENTS

JP 2001-92192 4/2001
JP 2008-100458 5/2008
(Continued)

*Primary Examiner* — Prasad Gokhale
(74) *Attorney, Agent, or Firm* — Workman Nydegger

(57) ABSTRACT

A printer includes a medium storage section that stores a medium; a recording transport path that is a transport path transporting the medium that is fed from the medium storage section and extends on an upstream side and a downstream side of an ink jet recording head; a switchback path that transports a recording sheet in a reverse direction of a transporting direction by switching back the recording sheet after transporting the recording sheet that has passed through the recording transport path and bends the recording sheet by making a first surface facing the ink jet recording head be an inside of the recording sheet; and an invert path that inverts the switchback recording sheet by bypassing the recording sheet on an upper side of the ink jet recording head and makes the medium be confluent with the recording transport path at a position on an upstream side of the ink jet recording head. A second transport path is formed along a fourth transport path.

15 Claims, 13 Drawing Sheets

(51) Int. Cl.

| | |
|---|---|
| ***B65H 5/06*** | (2006.01) |
| ***B65H 5/26*** | (2006.01) |
| ***B65H 5/36*** | (2006.01) |
| ***B65H 29/60*** | (2006.01) |
| ***B65H 29/12*** | (2006.01) |
| ***B65H 29/14*** | (2006.01) |
| ***B65H 85/00*** | (2006.01) |
| ***B41J 3/60*** | (2006.01) |
| ***B41J 13/00*** | (2006.01) |

(56) References Cited

U.S. PATENT DOCUMENTS 8,308,285 B2 * 11/2012 Akihiro ..... B41J 3/543 347/102
8,500,124 B1 * 8/2013 Reidhaar ..... B65H 29/58 271/186
2009/0108517 A1 * 4/2009 Guerand ..... B65H 29/58 271/225
2009/0185846 A1 7/2009 Okamoto
2009/0224458 A1 * 9/2009 Muratani ..... B65H 5/062 271/3.14
2011/0062661 A1 * 3/2011 Shimonaga ..... B41J 3/60 271/272
2012/0161387 A1 * 6/2012 Horade ..... B65H 3/0684 271/225
2013/0134661 A1 * 5/2013 Yoshinaga ..... B65H 85/00 271/225
2013/0149018 A1 * 6/2013 Oh ..... B41J 3/60 399/381
2014/0183811 A1 * 7/2014 Takenaka ..... B65H 31/24 271/3.19
2014/0353908 A1 * 12/2014 Kobayashi ..... B65H 9/00 271/226
2015/0091239 A1 * 4/2015 Iwasawa ..... G03G 15/234 271/3.18
2015/0145203 A1 * 5/2015 Kobayashi ..... B65H 1/04 271/288

FOREIGN PATENT DOCUMENTS

| | | |
|---|---|---|
| JP | 2008-188877 | 8/2008 |
| JP | 2008-188878 | 8/2008 |
| JP | 2009-083225 | 4/2009 |
| JP | 2010-111508 | 5/2010 |
| JP | 2012-246150 | 12/2012 |
| JP | 2013-071833 | 4/2013 |

* cited by examiner

RECORDING APPARATUS

BACKGROUND

1. Technical Field

The present invention relates to a recording apparatus that performs recording on a medium and particularly, a recording apparatus that is capable of performing recording on both surfaces of the medium.

2. Related Art

There is an ink jet printer as an example of a recording apparatus and the ink jet printer has a configuration in which recording is performed on a first surface of a recording sheet as an example of a medium and the recording sheet is inverted, and then recording can be performed on a second surface that is a rear surface of the first surface, that is, the recording can be performed on both surfaces.

An ink jet recording apparatus described in JP-A-2009-083225 is configured such that when performing printing on both surfaces of a sheet, the sheet after one surface (first surface) is printed is discharged on a discharge tray outside of an apparatus body by a discharge roller and then the sheet is on standby on the discharge tray until a standby time elapses according to an ink amount when printing one surface in a state of a printed surface of the sheet facing upward. Then, the sheet is transported to a printing position by an ink jet head after the standby time elapses, the other surface (second surface) is printed, and the sheet is discharged. In this case, image quality of the double-sided printing is stabilized and miniaturization is achieved.

However, since the sheet swells by absorbing the ink, particularly, the sheet on which the recording is performed on the first surface of the sheet tends to be warped making the shape of the first surface thereof convex. Then, when such a sheet is inverted, since the second surface of the sheet is shaped concavely, when printing on the second surface, a leading end of the sheet and a trailing end of the sheet are lifted, there is a concern that the leading end or the trailing end of the sheet is rubbed with a recording head, and then a decrease in recording quality is caused by an inappropriate gap between the head and the sheet.

SUMMARY

An advantage of some aspects of the invention is preventing or suppressing a decrease in recording quality when recording is performed on both surfaces, particularly, when recording is performed on a second surface.

According to an aspect of the invention, there is provided a recording apparatus including: a medium storage section that stores a medium; a first transport path that is a transport path transporting the medium that is fed from the medium storage section, passes through the recording section performing recording on the medium, and extends on an upstream side and a downstream side of a recording section; a second transport path that is a transport path connected to the first transport path and transports the medium in a reverse direction of a transporting direction by switching back the medium after transporting the medium that has passed through the recording section; a third transport path that is a transport path connected to the second transport path, inverts the medium that is transported in the reverse direction, and makes the medium be confluent with the first transport path at a position on the upstream side of the recording section; and a fourth transport path that is a transport path connected to the first transport path, bends the medium that has passed through the reading section, and discharges the medium by inverting the medium. The second transport path bends the medium by making a first surface facing a recording head configuring the recording section be the inside of the medium that has passed through the first transport path, and the second transport path is formed along the fourth transport path.

In this case, the second transport path transporting the medium in the reverse direction of the feeding direction by switching back the medium after transporting the medium that has passed through the recording section bends the medium by making the first surface facing the recording head configuring the recording section be the inside of the medium that has passed through the first transport path. Thus, the medium is in a state where a second surface side opposite to the first surface is shaped convexly. Therefore, it is possible to suppress lifting of a leading end or a trailing end when recording is performed on the second surface and to prevent or suppress a decrease in recording quality when recording is performed on the second surface. In addition, the second transport path (switchback path) is formed along the fourth transport path that discharges the medium by bending and inverting the medium that has passed through the recording section. Thus, the second transport path (switchback path) and the fourth transport path do not respectively occupy independent regions individually within the recording apparatus and it is possible to achieve further miniaturization of the apparatus.

Furthermore, in the following description, for the sake of convenience, the second transport path may be called "switchback path" or the switchback path may be appended to the second transport path, and the third transport path may call as "invert path" or the invert path may be appended to the third transport path. Furthermore, in the following description, the fourth transport path may call as "face-down discharge path" or the face-down discharge path may be appended to the fourth transport path.

In the recording apparatus, the second transport path and the fourth transport path may be configured such that the medium protruding from the second transport path and the medium discharged from the fourth transport path overlap in a horizontal direction. State where a first medium is discharged from the fourth transport path and a state where a second medium following the first medium protrudes from the second transport path may be controlled so as not to be formed simultaneously.

In this case, since in the second transport path (switchback path), the medium is formed protrudably from an end portion on the downstream side in the transport direction of the medium when transporting the medium that has passed through the recording section, it is possible to cope with a long medium. Then, since the state where the medium protrudes from the second transport path (switchback path) and the state where the medium is discharged from the fourth transport path (face-down discharge path) are controlled so as not to be formed simultaneously, the medium that protrudes from the second transport path (switchback path) and the medium that is discharged from the fourth transport path (face-down discharge path) do not overlap and it is possible to prevent contamination of a recording surface due to overlapping of the medium.

In the recording apparatus, a roller coming into contact with the first surface of the medium in the second transport path may be a serrated roller having a plurality of teeth on an outer periphery.

In this case, since the roller coming into contact with the first surface of the medium in the second transport path (switchback path) is a serrated roller having a plurality of teeth on an outer periphery, it is possible to suppress transcription or white spots in the first surface that is the recording surface.

In the recording apparatus, a first transport mechanism that transports the medium in the first transport path and a second transport mechanism that transports the medium in the second transport path may be independently driven.

In this case, since the first transport mechanism that transports the medium in the first transport path and the second transport mechanism that transports the medium in the second transport path (switchback path) can be independently driven, it is possible to improve a degree of freedom of control in the second transport path (switchback path) and to obtain a good recording result by adjusting a degree of shaping in the second transport path (switchback path).

In the recording apparatus, in the medium directed from the second transport path to the third transport path, the first surface may be bent by making the first surface be the inside of the medium on a downstream side of a pair of rollers provided at the end of the second transport path.

In this case, in the medium directed from the second transport path (switchback path) to the third transport path (invert path), the first surface is bent on a downstream side of the pair of rollers provided at the end of the second transport path (switchback path) by making the first surface be the inside of the medium. Thus, it is possible to perform shaping (second surface side is shaped convexly) of the medium on the downstream side of the pair of rollers provided in the end of the second transport path (switchback path) in addition to the second transport path (switchback path). As a result, it is possible to further reliably suppress lifting of the leading end of the medium or the trailing end of the medium, particularly when recording is performed on the second surface.

In the recording apparatus, a roller coming into contact with the first surface of the medium on an upstream side further than a pair of rollers immediately before being confluent with the first transport path in the third transport path may be a serrated roller having a plurality of teeth on an outer periphery.

In this case, since the roller coming into contact with the first surface of the medium on the upstream side further than the pair of rollers immediately before being confluent with the first transport path in the third transport path (invert path) is the serrated roller having the plurality of teeth on an outer periphery, it is possible to suppress the transcription or the white spots in the recording surface.

In the recording apparatus, the medium may be transported in the third transport path after the transportation of the medium is stopped in the second transport path for a predetermined time.

In this case, since the medium is transported in the third transport path (invert path) after the transportation of the medium is stopped in the second transport path (switchback path) for the predetermined time, it is possible to further reliably suppress lifting of the leading end or the trailing end of the medium by performing longer shaping to the medium (second surface side is shaped convexly) when recording is performed on the second surface.

In the recording apparatus, the second transport path may be formed such that the medium is capable of protruding from the end portion on the downstream side in the transport direction of the medium when transporting the medium that has passed through the recording section, and a state where the medium protrudes from the second transport path and a state where the medium is discharged from the fourth transport path may be controlled so as not to be formed simultaneously.

The recording apparatus may further include: a first flap that switches a downstream side of the first transport path and an upstream side of the second transport path between a connection state and a non-connection state, and a second flap that connects the second transport path and the third transport path when the first flap is switched from the connection state to the non-connection state.

The recording apparatus may further include: a first transport mechanism that transports the medium in the first transport path and a second transport mechanism that transports the medium forwardly and reversely in the second transport path, in which the first transport mechanism and the second transport mechanism may be respectively independently driven.

In the recording apparatus, when the first flap is in the connection state, a trailing end side of the second medium transported from the first transport path to the second transport path in a transport direction may pass through the first flap, thereafter, the first flap may be switched to the non-connection state, and thereafter, the first medium may be transported from the recording section to the fourth transport path and the second medium may be transported to the third transport path by driving the second transport mechanism by connection of the second flap before the first medium is discharged from the fourth transport path.

In the recording apparatus, the second medium that is transported to the second transport path may be on standby for a predetermined time in the second transport path.

In the recording apparatus, when the first flap is in the connection state, a trailing end side of the second medium transported from the first transport path to the second transport path in a transport direction may pass through the first flap and thereafter, the first flap may be switched to the non-connection state, and, thereafter, a third medium following the second medium may be fed from the medium storage section and the second medium may be transported to the third transport path by driving the second transport mechanism by the connection of the second flap before the first flap is connected so that the third medium passes through the recording section and is directed to the second transport path.

In the recording apparatus, the second medium may be transported to the third transport path before the first medium is discharged from the fourth transport path. The recording apparatus may include a second transport path member that has the second transport path, and a fourth transport path member that has the fourth transport path. The second transport path member may have a roller for transporting the medium and the fourth transport path member may have a roller for transporting the medium. The second transport path member and the fourth transport path member may be configured to be displaced between a mounting state in which the second transport path member and the fourth transport path member are adjacent to each other and a separation state in which the second transport path member and the fourth transport path member are separated from each other. In this case, it is possible to easily remove the medium when the medium is jammed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described based on the drawings, but the invention is not limited to the embodiments described below and may be modified in various ways within the scope of the invention described in the claims. Hereinafter, one embodiment is described assuming that the various modifications are included within the invention.

Figure 1:
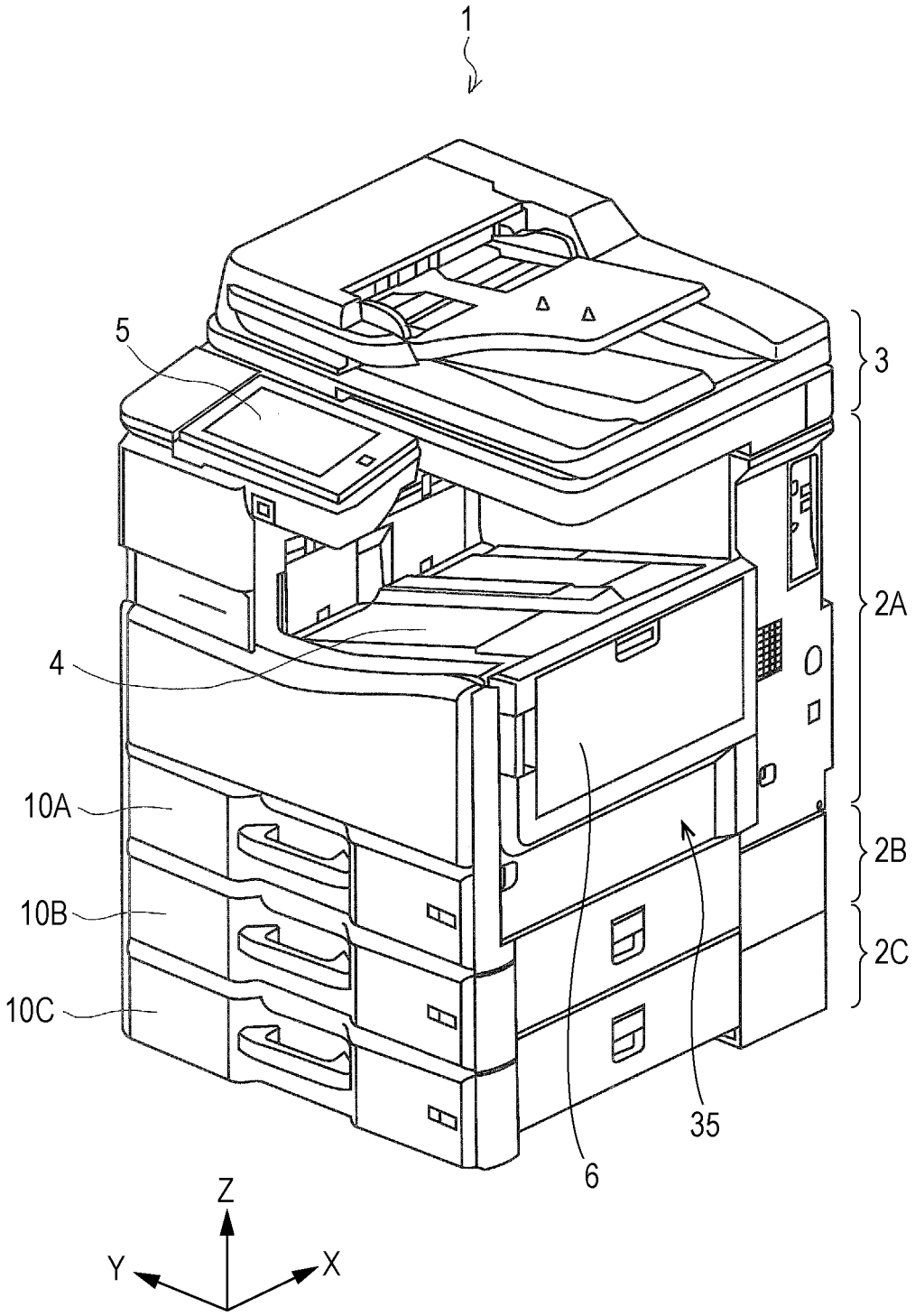
FIG. 1 is an external perspective view of an ink jet printer according to an embodiment of the invention.

FIG. 1 is an external perspective view of an ink jet printer (hereinafter, referred to as "printer") 1 that is an embodiment of "recording apparatus" according to the invention, FIGS. 2 to 9 are side cross-sectional views illustrating a sheet transport path of the printer 1, and FIGS. 10A, 10B, 11A, 11B, and 12 are enlarged views a main portion of the sheet transport path of the printer 1. In addition, FIG. 13 is a flowchart illustrating control when recording is performed on both surfaces.

Hereinafter, an entire configuration of the printer 1 that performs ink jet recording on a recording sheet as an example of a medium will be outlined with reference to FIGS. 1 and 2.

The ink jet printer 1 in FIG. 1 includes a scanner device 3 on an upper portion of an apparatus body 2A performing the recording on the recording sheet and includes extension units 2B and 2C on a lower side of the apparatus body 2A. The apparatus body 2A includes a sheet cassette 10A, the extension unit 2B includes a sheet cassette 10B, and the extension unit 2C includes a sheet cassette 10C. The extension units 2B and 2C are optional units for increasing the number of storage sheets and are optionally attached to the apparatus body 2A.

Reference numeral 5 is an operation section for performing various operations of the printer 1, reference numeral 4 is a tray for receiving the recording sheet that is discharged after recording is performed, and more specifically, is a face-down sheet discharge tray for receiving the recording sheet that is discharged by making a recording surface on which the last recording is performed be a lower side. Reference numeral 35 is a feeding unit and the feeding unit 35 can be open and closed with respect to the apparatus body 2A by rotating about a pivot point (not illustrated). Reference numeral 6 is a manual feeding tray provided in the feeding unit 35 and the manual feeding tray 6 is rotated about a rotation shaft 6*a* illustrated in FIG. 2 and can be opened and closed. The manual feeding tray 6 illustrated in FIG. 2 takes a received posture and is opened in the clockwise direction from the state of FIG. 2, and manual sheet feeding can be performed in a state where the manual feeding tray 6 faces obliquely upward.

Moreover, a side of the printer 1 on which the operation section 5 is disposed is a front side of the apparatus and a side on which the manual feeding tray 6 is provided is a right side of the apparatus. That is, feeding, transport, and discharge of the sheet in the printer 1 are performed along a right-left direction of the apparatus. A face-up discharge tray 7 (FIG. 2) (not illustrated in FIG. 1) described below is provided on a left side surface of the apparatus.

Subsequently, the sheet transport path in the printer 1 will be outlined with reference to FIG. 2. The printer 1 has three sheet feeding paths of a feeding path (see cassette feeding trajectory S1) from the sheet cassette 10A, a feeding path (see an extension cassette feeding trajectory S2) from the extension cassettes 10B and 10C that are not illustrated in FIG. 2, and a feeding path (see a manual feeding path S3) from the manual feeding tray 6.

Furthermore, the printer 1 has two sheet discharge methods of a face-up discharge (see a face-up discharge trajectory T1) method in which a recording surface on which the last recording is performed is discharged while the recording surface is facing upward and a face-down discharge (see a face-down discharge trajectory T2) method in which the recording surface on which the last recording is performed is discharged while the recording surface is facing downward.

Figure 2:
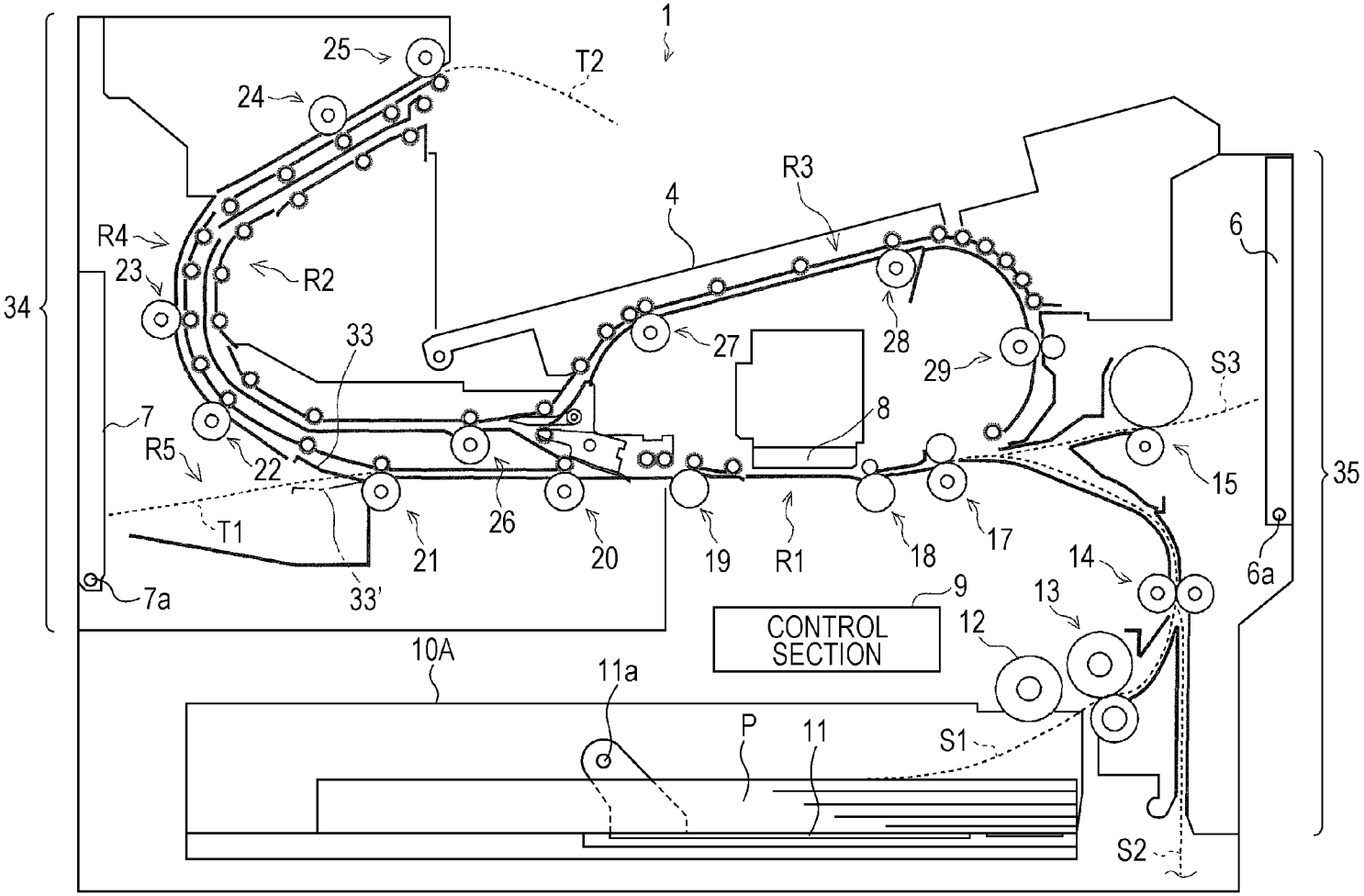
FIG. 2 is a side cross-sectional view illustrating a sheet transport path of the ink jet printer according to an embodiment of the invention.

Furthermore, in FIG. 2, reference numeral 7 represents the face-up sheet discharge tray for receiving the face-up discharged sheet. The face-up discharge tray 7 may take a received state illustrated in FIG. 2 and an opened state (not illustrated) by rotating about a rotation shaft 7*a*.

Then, the printer 1 includes five sheet transport paths of a recording transport path R1 as "first transport path", a switchback path R2 as "second transport path", an invert path R3 as "third transport path", a face-down discharge path R4 as "fourth transport path", and a face-up discharge path R5.

Figure 3:
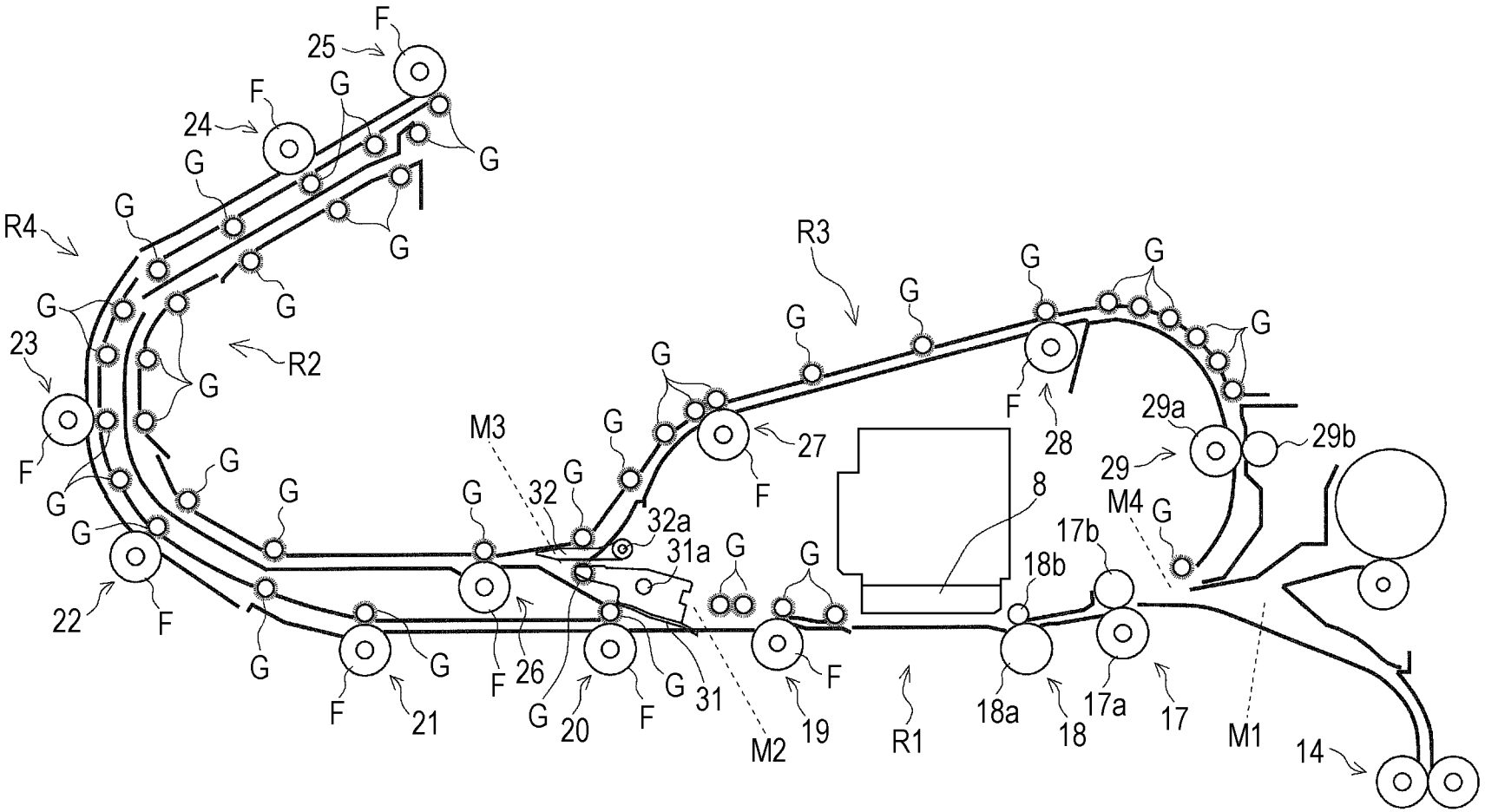
FIG. 3 is a side cross-sectional view illustrating the sheet transport path of the ink jet printer according to an embodiment of the invention.

Paths except for the face-up discharge path R5 of the five sheet transport paths are described later with reference to FIG. 3 or later and, here, only the face-up discharge path R5 is outlined.

Reference numeral 33 in FIG. 2 represents a flap (path switching member) that is driven by a driving source (not illustrated) and the flap 33 is switched between a state of being illustrated in a solid line and in reference numeral 33 and a state of being illustrated in an virtual line and in reference numeral 33' in FIG. 2.

The flap 33 is in a state of being illustrated in the solid line in FIG. 2 and the recording sheet is guided to the face-down discharge path R4 and is face-down discharged as illustrated in the face-down discharge path T2. The flap 33 is in a state of being illustrated in the virtual line and the reference numeral 33' in FIG. 2 and the recording sheet is guided to the face-up discharge path R5 and is face-up discharged as illustrated in the face-up discharge trajectory T1.

Moreover, reference numeral 9 in FIG. 2 represents a control section performing various controls. The control section 9 controls an ink jet recording head 8 described below or various rollers driven by a motor (not illustrated) and each path switching member (flap) and performs necessary control based on detection states of various sensors (not illustrated) (for example, a sensor for detecting passage of the recording sheet). In addition, in FIG. 2, the control section 9 is conceptually illustrated and, in fact, is configured of a circuit substrate provided in a predetermined position within the apparatus body 2A.

Hereinafter, in FIG. 2, a sheet feeding path to a transport roller pair 17 will be described.

The sheet cassette 10A detachably provided in the apparatus body 2A includes a hopper 11. The hopper 11 swings about a shaft 11*a* and thereby a recording sheet P stored in the sheet cassette 10A comes into contact with or separates from a feeding roller 12 that is driven to rotate by a motor (not illustrated).

The recording sheets fed by the feeding roller 12 from the sheet cassette 10A are separated (double feed prevention) by passing through a nip position by a separation roller pair 13 and reach the transport roller pair 17 by receiving a transporting force from a transport roller pair 14. Similarly, the extension units 2B and 2C (FIG. 1) positioned below the apparatus body 2A include a feeding roller 12 and the separation roller 13, and the recording sheet P fed from each sheet cassette reaches the transport roller pair 17 by receiving a transporting force from the transport roller pair 14 illustrated in FIG. 2.

The recording sheet P supplied through the manual feeding tray 6 reaches the transport roller pair 17 by receiving a feeding force from a feeding roller pair 15.

Hereinafter, the sheet transport path on the downstream side further than the transport roller pair 17 will be described with reference to FIG. 3. In addition, FIG. 3 or later are illustrated assuming that the recording sheet is face-down discharged through the face-down discharge path R4 and hereinafter, the description will be made assuming this.

First, a roller provided in each sheet transport path is described. In FIG. 2, reference numerals 17 to 29 represent all transport roller pairs transporting the recording sheet. Particularly, one side roller of transport roller pairs 19 to 28 is illustrated with a symbol F and the other side roller is illustrated with a symbol G. The roller F is a driving roller that is driven by a motor (not illustrated) and, as an example, a plurality of the rollers F are rubber rollers that are provided having an appropriate interval from each other in a sheet width direction.

The rollers G are a driven roller that are driven to rotate by coming into contact with the recording sheet and are provided in a pair with the rollers F having an appropriate interval from each other in the sheet width direction. The roller G is a serrated roller having a plurality of teeth on an outer periphery and controls white spots or transcription of ink of the recording surface on which the recording is performed already by coming into point contact with the recording surface.

In addition, the driven roller G is provided in an appropriate position on the sheet transport path and is, particularly, provided on a side coming into contact with the recording surface on which the recording is performed already in addition to configuring each transport roller pair.

Meanwhile, the transport roller pairs 17, 18, and 29 have configurations different from those of the transport roller pairs 19 to 28. Specifically, the transport roller pair 17 includes a driving roller 17*a* that is driven to rotate and a driven roller 17*b* capable of being driven to rotate, and the driven roller 17*b* is a resin roller having a smooth outer periphery surface. Similarly, the transport roller pair 18 includes a driving roller 18*a* that is driven to rotate and a driven roller 18*b* capable of being driven to rotate, and the driven roller 18*b* is a resin roller having a smooth outer periphery surface. Similarly, the transport roller pair 29 includes a driving roller 29*a* that is driven to rotate and a driven roller 29*b* capable of being driven to rotate, and the driven roller 29*b* is a resin roller having a smooth outer periphery surface.

The recording sheet is guided by upper and lower guiding members between respective rollers described above. In order to avoid complication in FIG. 3 and other drawings, a reference numeral is not given to the guiding member, but a bold line connecting between respective rollers indicates the guiding member.

Substantially, each of sheet transport paths (R1 to R4) will be described.

The recording transport path R1 as the first transport path passes through below an ink jet recording head 8 as the recording section in which the recording is performed on the recording sheet and extends to the upstream side and the downstream side thereof. In the embodiment, for the sake of convenience, the recording transport path R1 is substantially from a position M1 to a position M2 of FIG. 3. In the recording transport path R1, the recording sheet receives transporting forces from the transport roller pairs 17, 18, and 19.

In addition, the ink jet recording head 8 in the embodiment is a recording head that is provided such that the nozzles ejecting the ink cover an entire region of the sheet in the sheet width direction and is configured of the recording head capable of performing recording on an entirety of the sheet width because of not moving in the sheet width direction.

The switchback path R2 as the second transport path is a transport path connected to the recording transport path R1, is a path to transport the recording sheet in a reverse direction (right direction in FIG. 3) to the transporting direction by being switched back after the recording sheet is transported below the ink jet recording head 8 (left direction in FIG. 3), and is positioned on a curved inside of the face-down discharge path R4 described below. In the embodiment, for the sake of convenience, the switchback path R2 is substantially on a left side further than a position M3 in FIG. 3. The recording sheet in the switchback path R2 receives a transporting force from the transport roller pair 26.

The invert path R3 as the third transport path is a transport path connected to the switchback path R2, inverts the recording sheet transported in the reverse direction (right direction in FIG. 3) by bypassing the recording sheet on the upper side of the ink jet recording head 8, and is confluent with the recording transport path R1 at a position (position on the upstream side of the transport roller pair 17 in the embodiment) on the upstream side of the ink jet recording head 8. In the embodiment, for the sake of convenience, the invert path R3 is a path substantially from the position M3 to a position M4 of FIG. 3. The recording sheet in the invert path R3 receives the transporting force from the pairs of transporting rollers 27, 28, and 29.

The face-down discharge path R4 as the fourth transport path is a transport path connected to the recording transport path R1, bends the recording sheet passing through below the ink jet recording head 8 by making a surface of the recording sheet facing the ink jet recording head 8 be the inside, and is a path for discharging the recording sheet by inverting the recording sheet. In the embodiment, for the sake of convenience, the face-down discharge path R4 is substantially on a left side further than the position M2 in FIG. 3. The recording sheet in the face-down discharge path R4 receives transporting forces from the transport roller pairs 20, 21, 22, 23, 24, and 25.

Next, a connection section of each transport path is provided with a first flap 31 and a second flap 32 as path switching members performing switching the transport path. Hereinafter, the flaps will be described with reference to FIGS. 10A and 10B.

The first flap 31 is capable of swing about a swing fulcrum 31*a* by receiving a driving force from a driving unit (not illustrated). Furthermore, the second flap 32 is engageably provided with the first flap 31 through an engaging section (not illustrated) and swings about a swing fulcrum 32*a* according to the swing of the first flap 31.

Figure 10A:
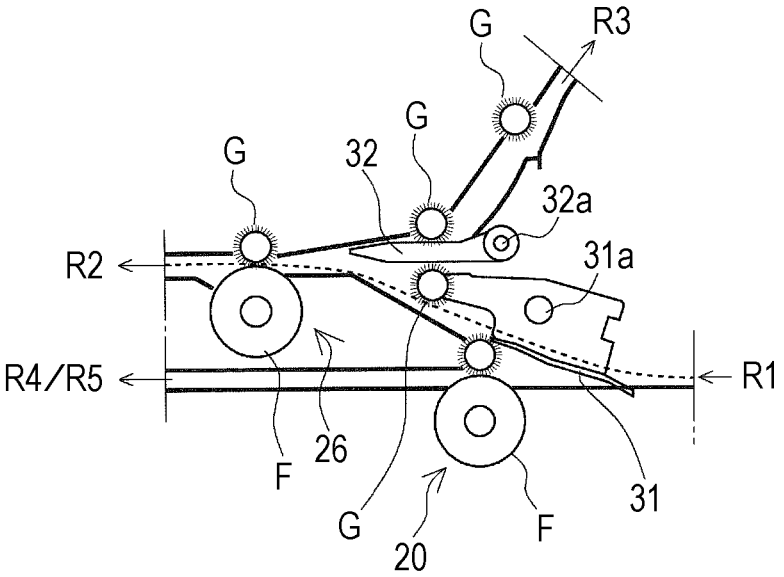
FIGS. 10A and 10B are enlarged views of a main portion of the sheet transport path of the ink jet printer according to an embodiment of the invention.

In a state of FIG. 10A, the first flap 31 guides the recording sheet from the recording transport path R1 to the switchback path R2 and the second flap 32 opens a connection path from the recording transport path R1 to the switchback path R2. A broken line in FIG. 10A represents a passage trajectory of the sheet from the recording transport path R1 to the switchback path R2.

Figure 10B:
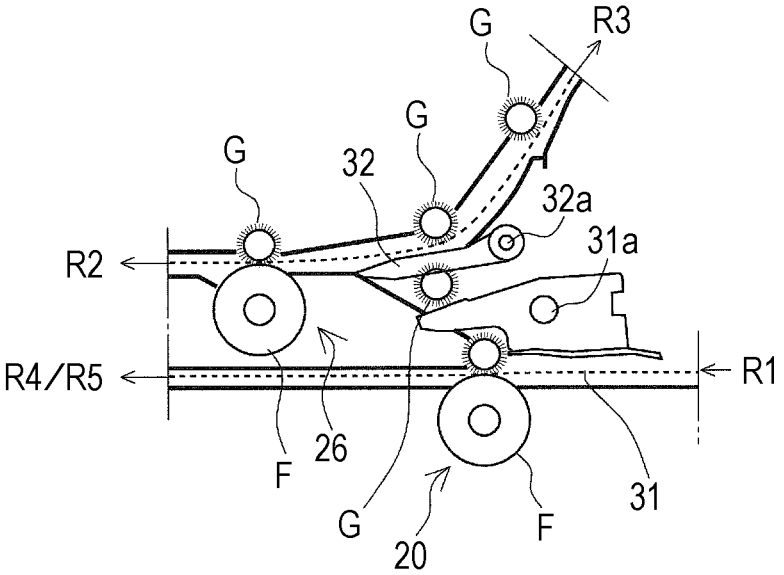

In a state of FIG. 10B, the first flap 31 guides the recording sheet from the recording transport path R1 to the face-down discharge path R4 (otherwise, the face-up discharge path R5) and the second flap 32 guides the recording sheet from the switchback path R2 to the invert path R3. Furthermore, the second flap 32 blocks the connection path between the recording transport path R1 and the switchback path R2 so that the recording sheet does not enter the recording transport path R1 from the switchback path R2. A broken line in FIG. 10B represents a passage trajectory of the recording sheet from the recording transport path R1 to the face-down discharge path R4 (otherwise, the face-up discharge path R5) and represents a passage trajectory of the recording sheet from the switchback path R2 to the invert path R3.

Substantially, an example of the sheet transport in the sheet transport path of the printer 1 configured as described above will be described with reference to FIG. 4 or later.

Figure 4:
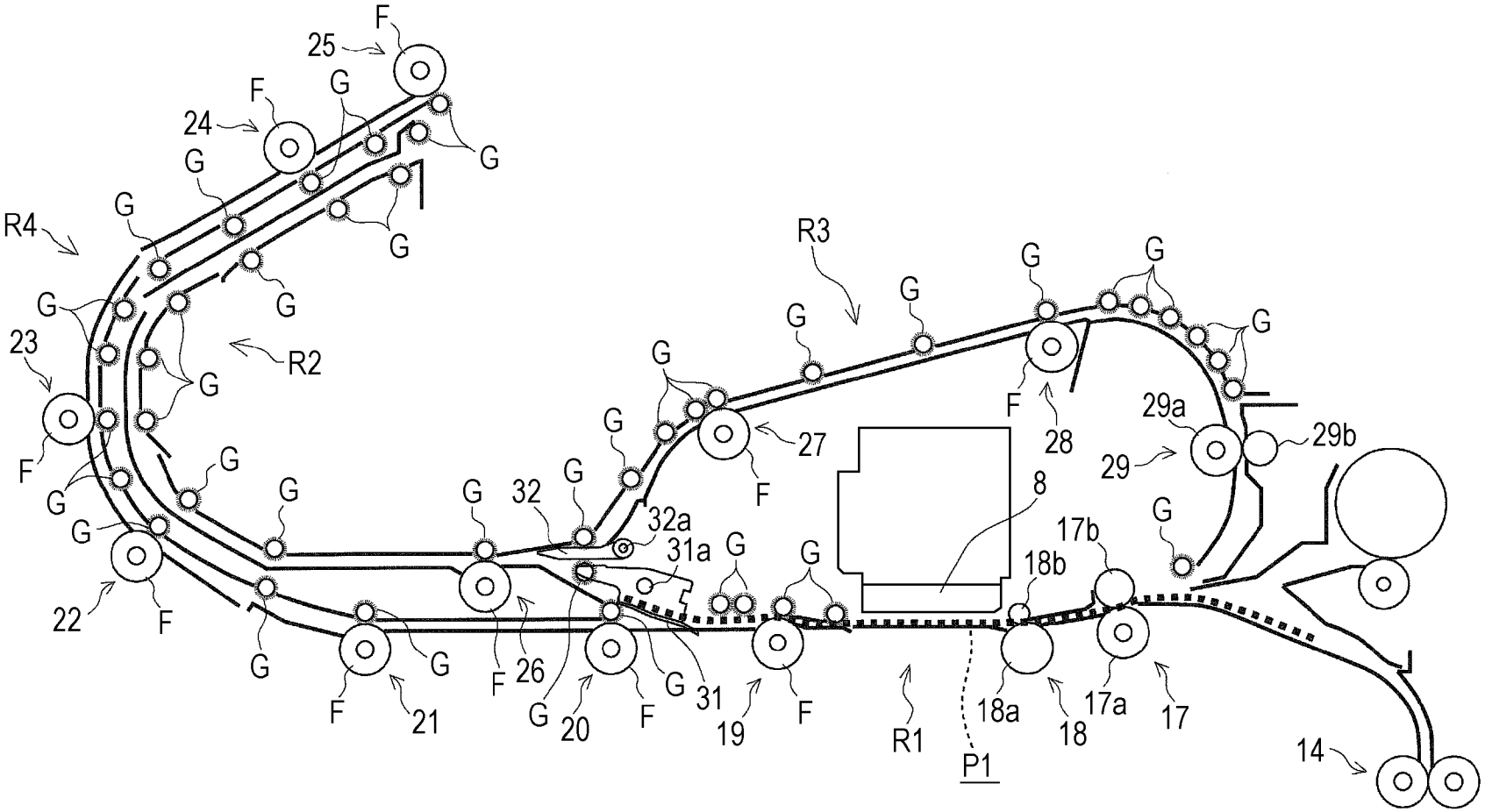
FIG. 4 is a side cross-sectional view illustrating the sheet transport path of the ink jet printer according to an embodiment of the invention.
Figure 5:
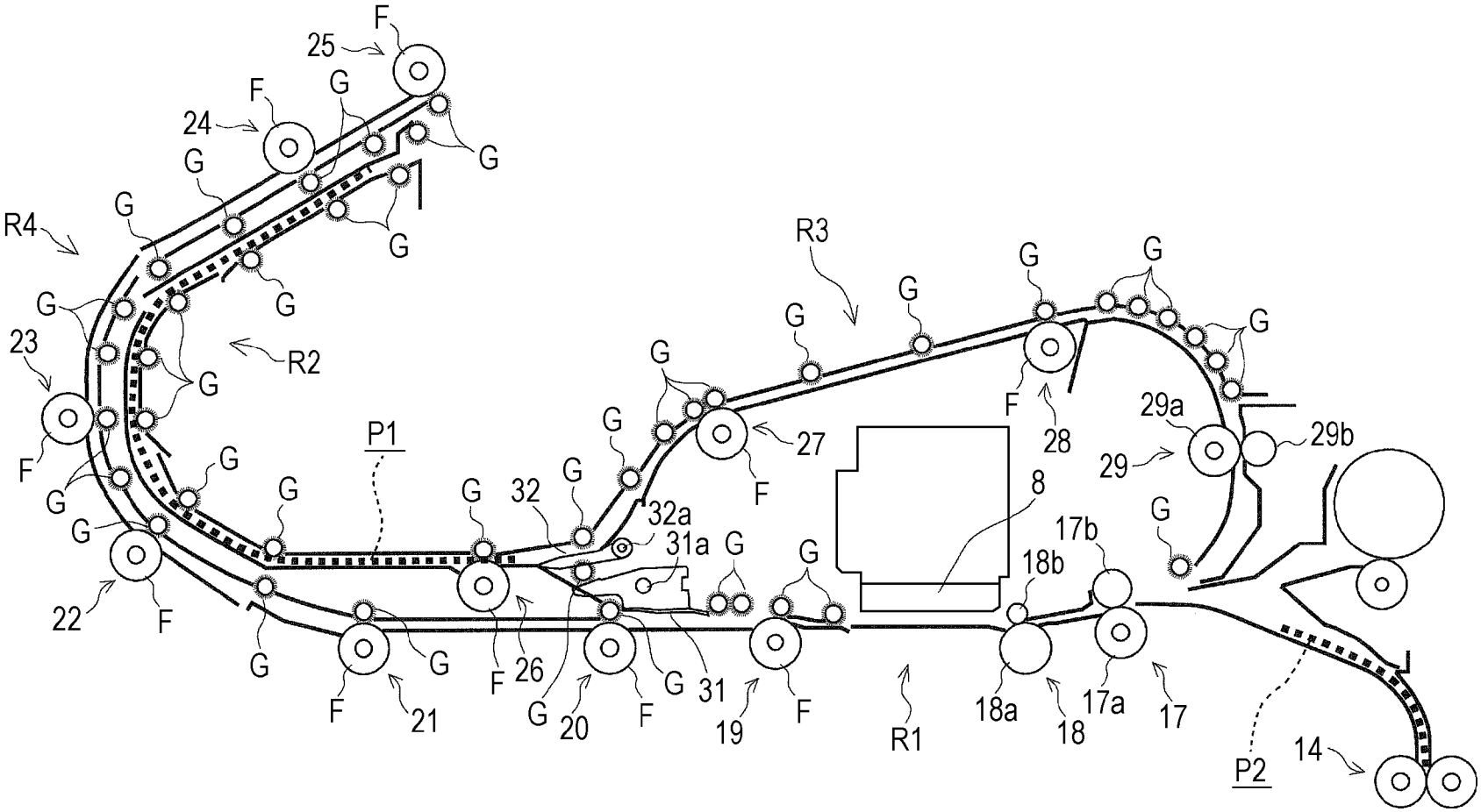
FIG. 5 is a side cross-sectional view illustrating the sheet transport path of the ink jet printer according to an embodiment of the invention.

Reference numeral P1 in FIG. 4 represents the recording sheet to be recorded first. When the recording is performed on the first surface of the recording sheet P1, as illustrated in FIG. 5, the recording sheet P1 is transported to the switchback path R2. At this time, the sheet feeding is simultaneously performed from the sheet cassette 10A and a second recording sheet P2 is fed to the upstream position of the transport roller pair 17.

Figure 6:
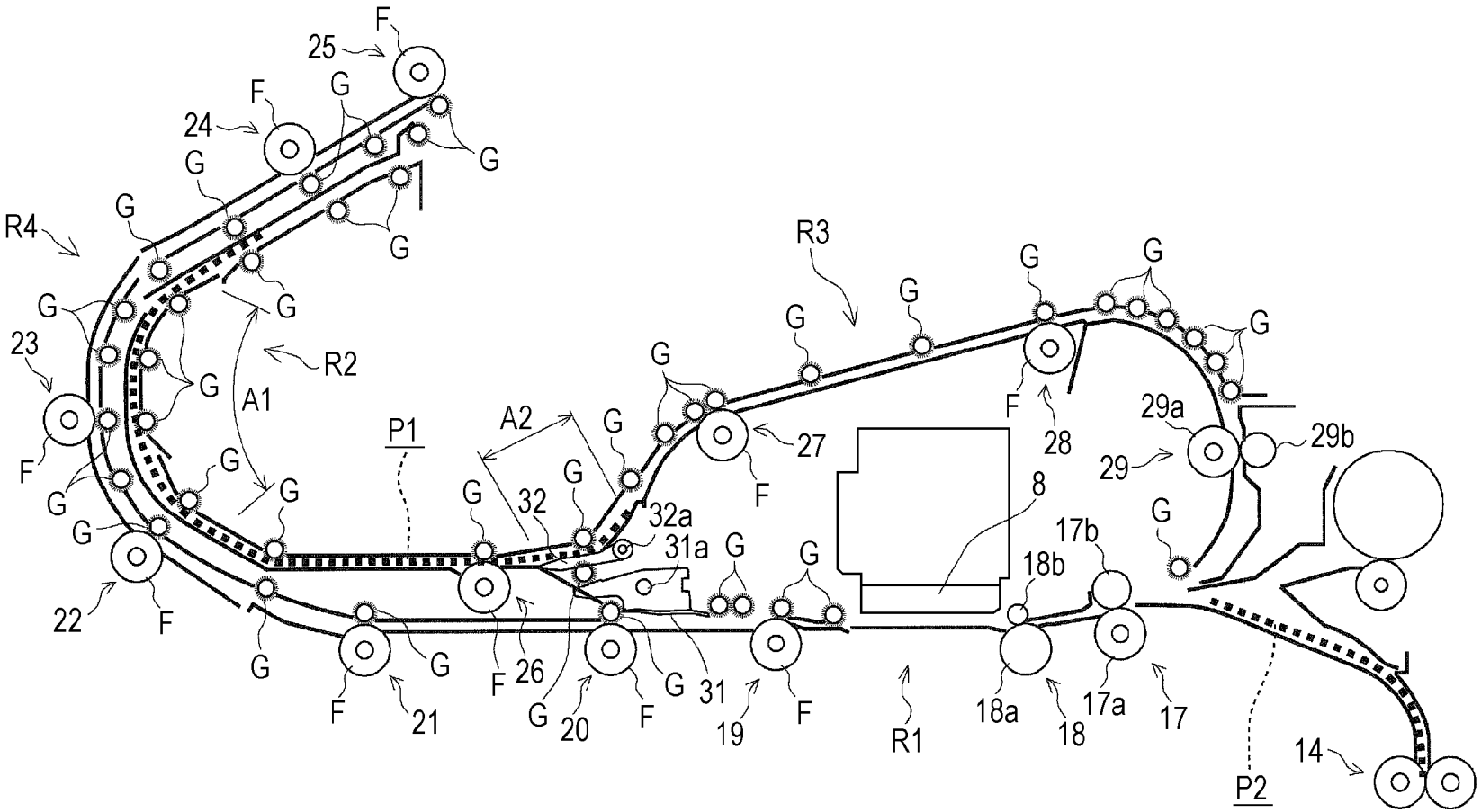
FIG. 6 is a side cross-sectional view illustrating the sheet transport path of the ink jet printer according to an embodiment of the invention.
Figure 7:
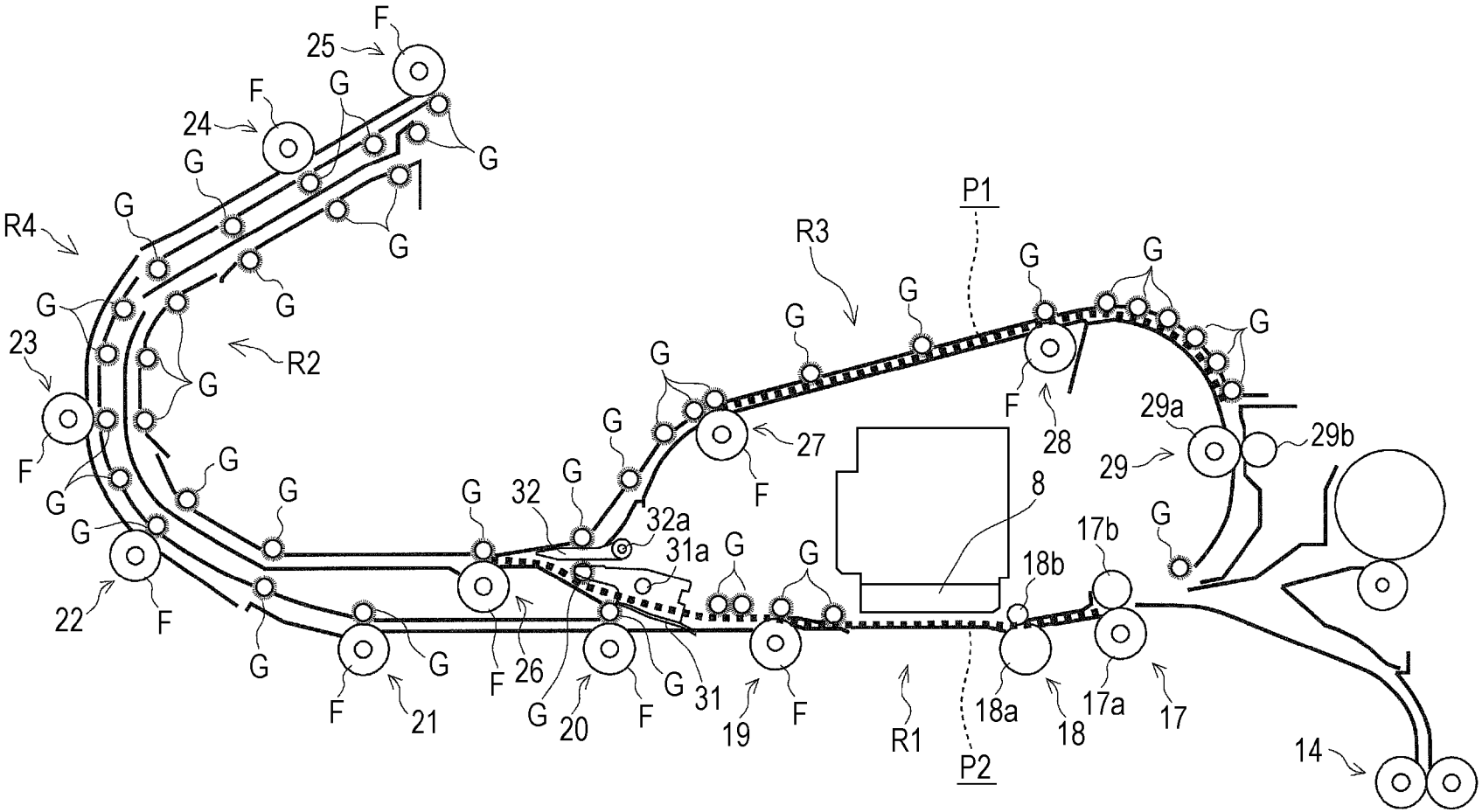
FIG. 7 is a side cross-sectional view illustrating the sheet transport path of the ink jet printer according to an embodiment of the invention.

Next, the first recording sheet P1 is transported to the invert path R3 as illustrated in FIGS. 6 and 7 by being switched back. The second recording sheet P2 is transported to the switchback path R2.

Figure 8:
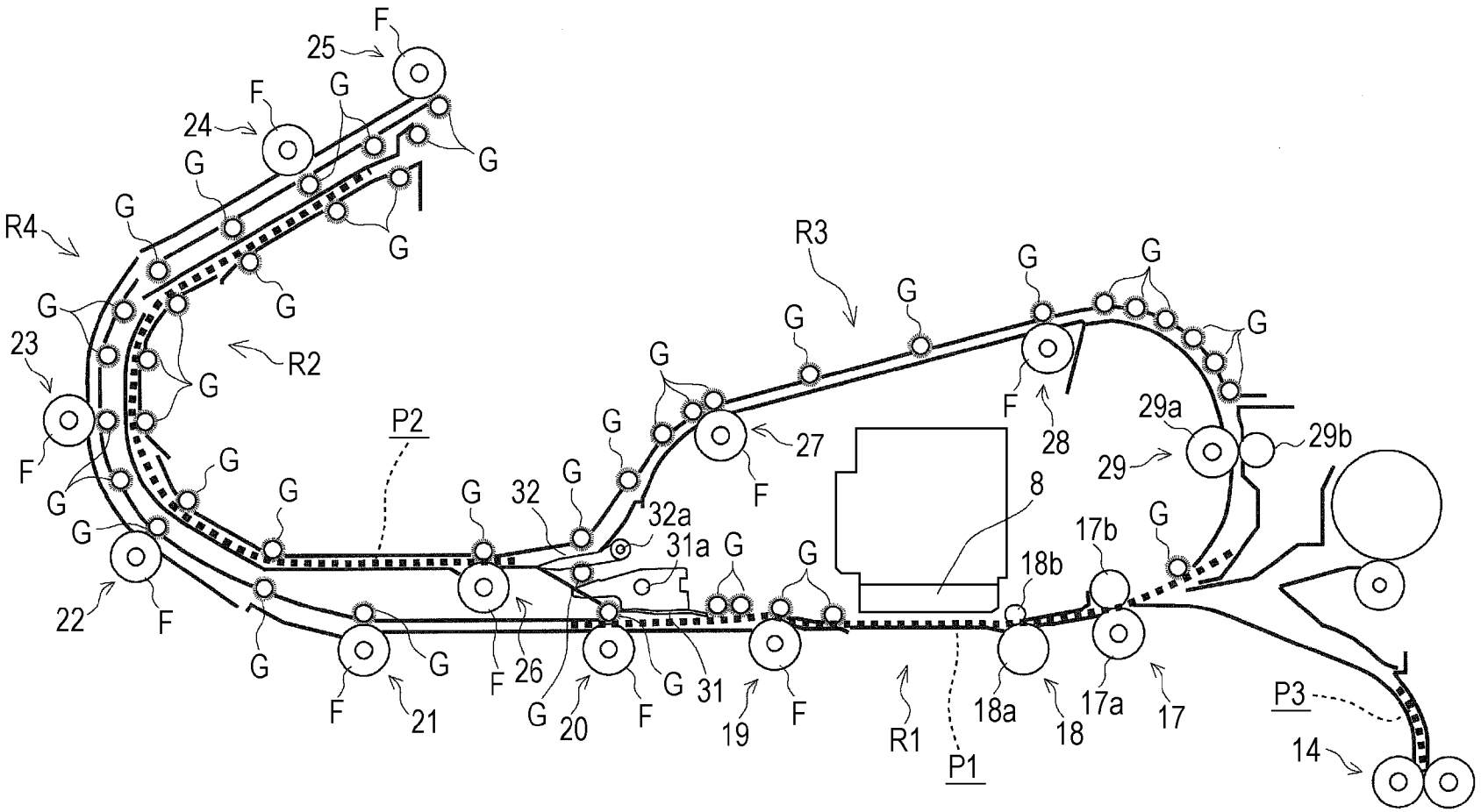
FIG. 8 is a side cross-sectional view illustrating the sheet transport path of the ink jet printer according to an embodiment of the invention.

Next, the recording sheet P1 transported to the invert path R3 is transported below the ink jet recording head 8 again as illustrated in FIG. 8 by being inverted and the recording is performed on the second surface that is a surface opposite to the first surface. The second recording sheet P2 is directed to the invert path R3 by being switched back. Furthermore, the sheet feeding is performed simultaneously from the sheet cassette 10A and a third recording sheet P3 is fed to a position of the upstream side of the transport roller pair 17.

Figure 9:
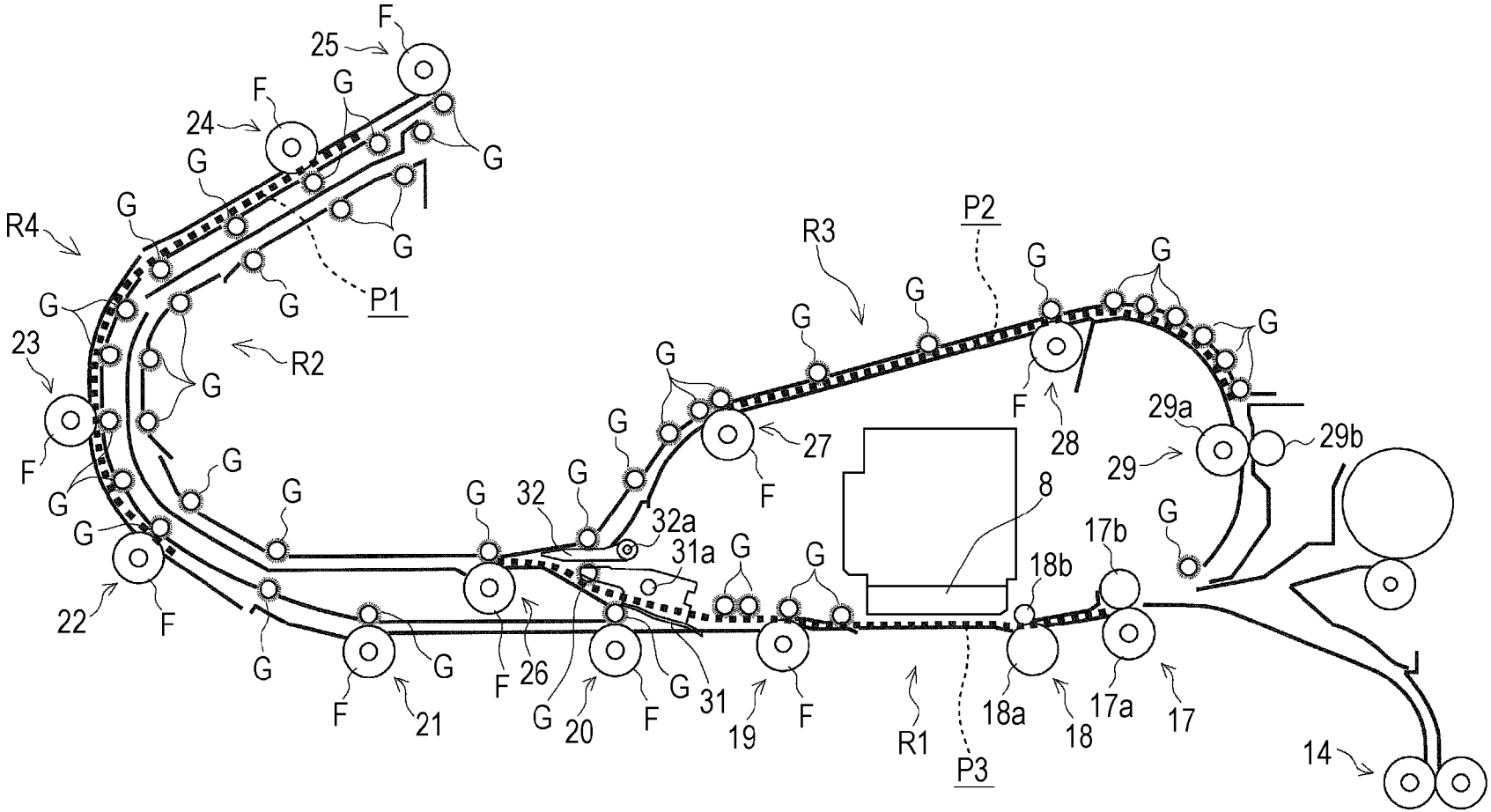
FIG. 9 is a side cross-sectional view illustrating the sheet transport path of the ink jet printer according to an embodiment of the invention.

Next, the first recording sheet P1 on which the recording is performed on the second surface passes through the face-down discharge path R4 as illustrated in FIG. 9 and then is face-down discharged. The second recording sheet P2 is inverted by the invert path R3 and then the recording is performed on the second surface. The first surface of the third recording sheet P3 is subjected to recording and the third recording sheet P3 is guided to the switchback path R2.

Thereafter, simultaneously, a fourth, fifth, etc. recording sheets are sequentially fed, and a series of processes of the recording and inverting of the first surface, the recording of the second surface, and discharging of the recording sheet are performed.

In addition, the control section 9 of the printer 1 uses the transport roller pair 29 in the invert path R3 and corrects skew of the recording sheet, that is, performs a so-called skew removal by abutting the leading end of the sheet to the transport roller pair 17 in a state where the rotation is stopped.

Since the printer 1 according to the embodiment has the dedicated switchback path R2 as described above, it is possible to feed the recording sheet to the next transport path sequentially and quickly without it being necessary to wait for processing of the preceding recording sheet. As a result, in the printer 1, it is possible to further achieve improvement of a throughput.

Substantially, characteristic configurations of the printer 1 according to the invention configured as described above will be further described.

First, the switchback path R2 in the printer 1 has a form in which the recording sheet that has passed through the recording transport path R1 is bent by making the first surface facing the ink jet recording head 8 be the inside.

Operational effects according to the configuration are as follows. That is, since the recording sheet swells by absorbing the ink, particularly, the recording sheet in which the recording is performed on the first surface tends to warp by making the shape of the first surface side of the sheet be convex. Then, if such a recording sheet is inverted, since the recording sheet is warped by making the shape of the second surface of the sheet be concave, when the second surface is recorded, the leading end of the sheet and the trailing end of the sheet are in a lifted state, the leading end or the trailing end of the sheet is rubbed with the ink jet recording head 8, and a gap between the ink jet recording head 8 and the recording sheet is not appropriate, and thereby the recording quality may be decreased.

However, in the switchback path R2 of the printer 1 according to the invention, since the recording sheet that has passed through the recording transport path R1 is formed in a bent state by making the first surface facing the ink jet recording head 8 be the inside, the recording sheet is in a state where the second surface side opposite to the first surface is shaped convexly. Thus, it is possible to suppress lifting of the leading end or the trailing end when the second surface is recorded and to prevent or suppress the decrease in the recording quality when the second surface is recorded.

Furthermore, since the switchback path R2 bends the recording sheet that has passed through below the ink jet recording head 8 and is formed along the face-down discharge path discharging the recording sheet by inverting the recording sheet, it is possible to achieve miniaturization of the apparatus further without the switchback path R2 and face-down discharge path occupying individual independent regions respectively within the apparatus.

Furthermore, since the driven roller G that is the roller coming into contact with the first surface (surface on which the recording is initially performed) of the recording sheet is the serrated roller having the plurality of teeth on the outer periphery in the switchback path R2, it is possible to suppress the transcription or white spots in the first surface, that is, the recording surface on which the recording is performed already.

Furthermore, if the transport roller pairs 17, 18, and 19 that transport the recording sheet in the recording transport path R1 are the first transport mechanism and the transport roller pair 26 transporting the recording sheet in the switchback path R2 is the second transport mechanism, the first transport mechanism and the second transport mechanism in the embodiment are configured to be independently driven. Thus, a degree of freedom of control in the switchback path R2 is improved and it is possible to obtain good recording effects by adjusting a degree of shaping in the switchback path R2.

Here, adjustment of the degree of shaping in the switchback path R2 can be performed by adjusting a stop time of the transport roller pair 26. The adjustment will be described with reference to FIG. 13.

FIG. 13 illustrates a flow of a recording operation with respect to one recording sheet and, for example, if the recording sheet P1 illustrated in FIGS. 4 to 9 is described as an example, first, the sheet feeding is performed (step S101), the recording is performed on the first surface (step S102: FIG. 4), and the recording sheet is transported to the switchback path R2 (step S103: FIG. 5).

The transport direction of the recording sheet P1 transported to the switchback path R2 is switched (switched back) in a state where the trailing end when the first surface is recorded is nipped by the transport roller pair 26 as illustrated in FIG. 5. At this time, since the driving of the transport roller pair 26 is stopped for a predetermined time, that is, wait of a time t1 is provided (step S104), shaping of the recording sheet in a state where the second surface side opposite to the first surface is convex is reliably performed by making the second surface side be convex.

Next, the recording sheet P1 is transported to the invert path R3 (step S105: FIG. 7) and is inverted (step S106: FIG. 8), and the recording is performed on the second surface (step S107: FIG. 8). The recording sheet P1 in which the recording is performed on the second surface is transported to the face-down discharge path R4 (step S108: FIG. 9) and is discharged (step S109).

In addition, the wait time t1 can be adjusted by contents of the first surface recording. For example, if the recording on the first surface is only text printing which is small in an ink ejecting amount, the wait time t1 is short, or may be zero. Of course, if the recording is performed only on the second surface without performing the recording on the first surface, the wait time t1 may be zero. Furthermore, it is also possible to adjust the wait time t1 depending on a recording duty value when recording is performed on the first surface.

Here, the recording duty value is a ratio of covering the ink per unit area of the recording surface. For example, if the recording duty value is 50%, 50% of unit area of the recording surface is covered by the ink.

Thus, for example, if the recording duty value is high, since a degree of swelling due to absorption of the ink, that is, the lifting of the sheet when the recording is performed on the second surface, is remarkable, the wait time t1 is increased. In contrast, if the recording duty value is low, the wait time t1 is decreased (including zero).

Thus, it is possible to effectively suppress lifting of the leading end region or the trailing end region when the recording is performed on the second surface and to prevent or suppress the decrease in the recording quality when the recording is performed on the second surface while suppressing the decrease in the recording throughput to the minimum.

Furthermore, if attention is paid to suppression of the lifting of the leading end region or the trailing end region when the recording is performed on the second surface, the recording duty value described above may be used as the recording duty value of the leading end region of the sheet or the trailing end region of the sheet when the recording is performed on the first surface. Thus, for example, even if a recording duty value of a center region of the sheet is high, if the recording duty value of the leading end region or the trailing end region of the sheet is low, it is possible to decrease the wait time t1 and to achieve both prevention of the decrease in the recording quality and prevention of the decrease in the throughput.

Furthermore, the wait time t1 may be adjusted depending on a type of the sheet. For example, if the recording sheet is thick as a glossy paper, since the degree of the swelling due to the absorption of the ink, that is, the lifting of the sheet when the recording is performed on the second surface, is small, the wait time t1 is shortened or is zero. In contrast, if the degree of the swelling of the recording sheet is remarkable due to the absorption of the ink as the recording sheet is a thin plain paper, the wait time t1 is increased.

As described above, if the wait time t1 is adjusted depending on the type of the sheet, it is possible to further appropriately and reliably suppress the lifting of the leading end region or the trailing end region when the recording is performed on the second surface and to prevent or suppress the decrease in the recording quality when the recording is performed on the second surface.

Furthermore, it is also possible to perform as follows by using the characteristics of the sheet transport paths according to the embodiment. In FIG. 6, the leading end of the recording sheet directed from the switchback path R2 to the invert path R3 is bent by making the first surface (upper side in the drawing) be the inside in a bent section A2 of the downstream side (right side in the drawing) of the transport roller pair 26 provided at the end of the switchback path R2.

A curvature of the bent section A2 is greater than a curvature of the bent section A1 in the switchback path R2 in the embodiment.

Thus, it is possible to perform more powerful shaping (shaping of the second surface side to be convex) in the leading end or the trailing end of the recording sheet on the downstream side of the transport roller pair 26 provided at the end of the switchback path R2 in addition to the switchback path R2. Particularly, if a wait time t2 is provided in a state of being illustrated in FIG. 6, it is possible to further reliably suppress the lifting of the leading end or the trailing end of the recording sheet particularly when the recording is performed on the second surface. In addition, both the wait time t1 and the wait time t2 may be set or one of both may be set.

Substantially, the characteristics of the printer 1 according to the invention will be further described. Since the driven roller G coming into contact with the first surface of the recording sheet on the upstream side further than the transport roller pair 29 immediately before being confluent with the recording transport path R1 in the invert path R3 is the serrated roller having the plurality of teeth on the outer periphery, it is possible to suppress the transcription or the white spots in the first surface.

Figure 11A:
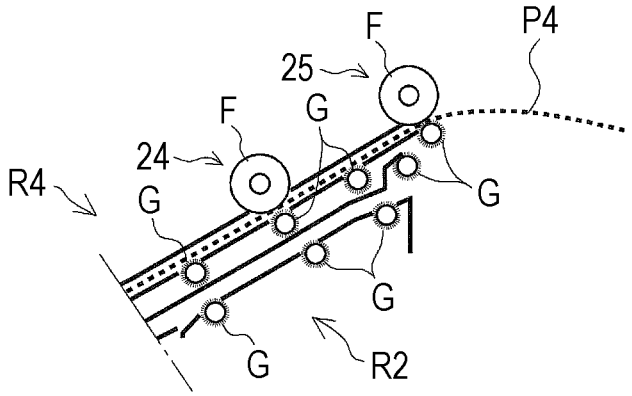
FIGS. 11A and 11B are enlarged views of a main portion of the sheet transport path of the ink jet printer according to an embodiment of the invention.
Figure 11B:
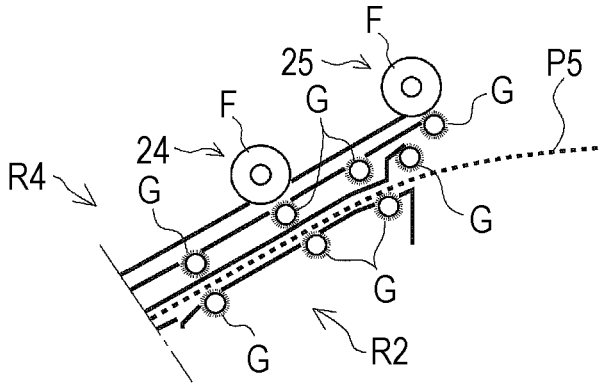

Furthermore, the switchback path R2 in the embodiment is formed such that the recording sheet can be protruded from the end portion on the downstream side in the transport direction when the recording sheet that has passed through (passing through the recording transport path R1) below the ink jet recording head 8 is transported. FIG. 11B illustrates this state and a recording sheet P5 is in a state of being protruded from the switchback path R2 to the outside. As described above, since the recording sheet can be protruded from the switchback path R2, even if the recording sheet having a large size (length is long) is inverted, it is possible to suppress enlargement of the apparatus without necessity to extend the switchback path R2.

Then, in the embodiment, control is performed such that a state where the recording sheet is protruded from the switchback path R2 and a state where the recording sheet is discharged from the face-down discharge path R4 are not generated simultaneously. FIG. 11A illustrates a state where a recording sheet P4 is discharged from the face-down discharge path R4, that is, the control section 9 of the printer 1 performs control such that a state of being illustrated in FIG. 11A and a state of being illustrated in FIG. 11B are not generated simultaneously.

Thus, the recording sheet (reference numeral P5 in FIG. 11B) protruding from the switchback path R2 and the recording sheet (reference numeral P4 in FIG. 11A) discharged from the face-down discharge path R4 are not overlapped and it is possible to prevent contamination of the recording surface due to overlapping of the recording sheet.

Figure 12:
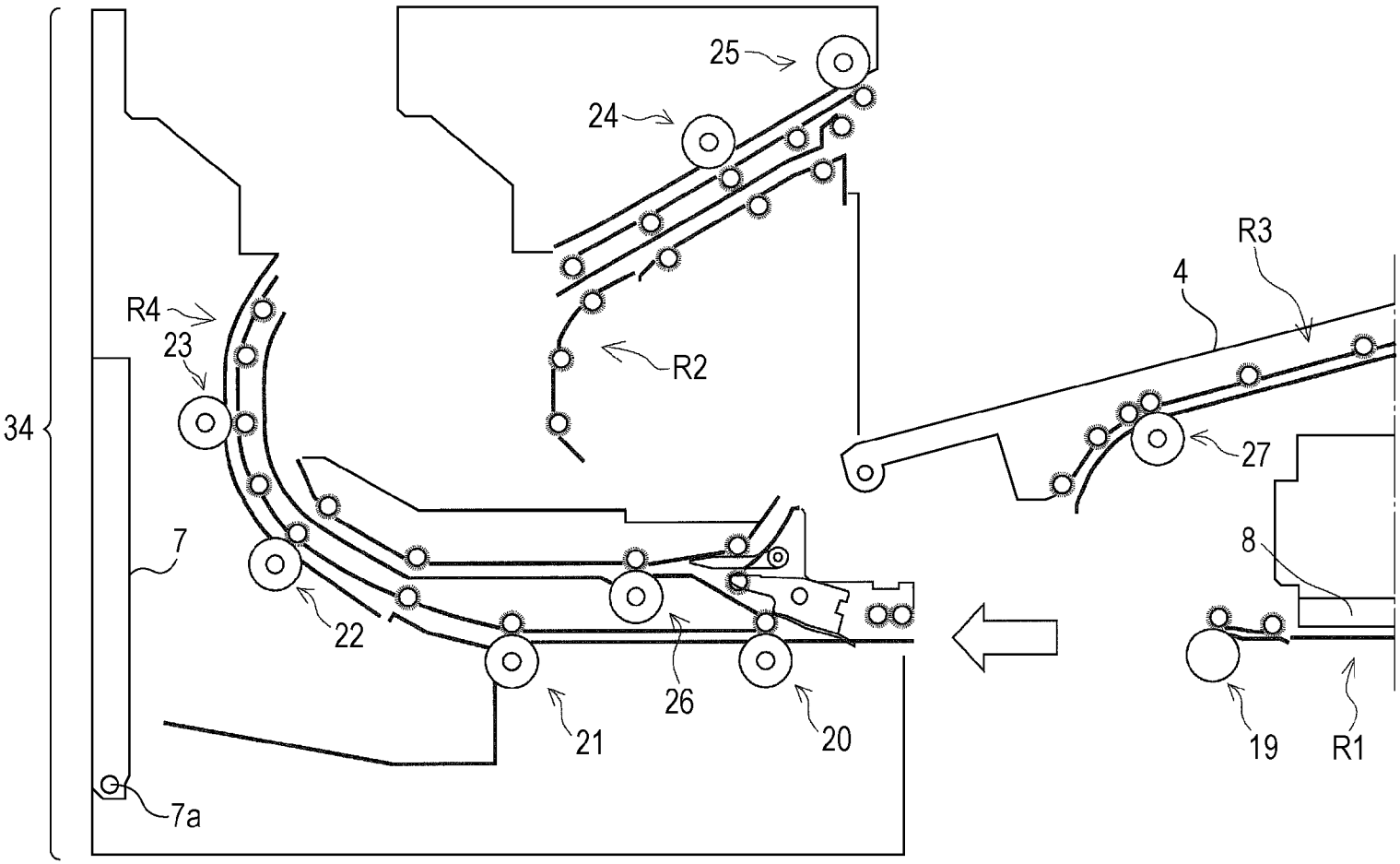
FIG. 12 is an enlarged view of a main portion of the sheet transport path of the ink jet printer according to an embodiment of the invention.
Figure 13:
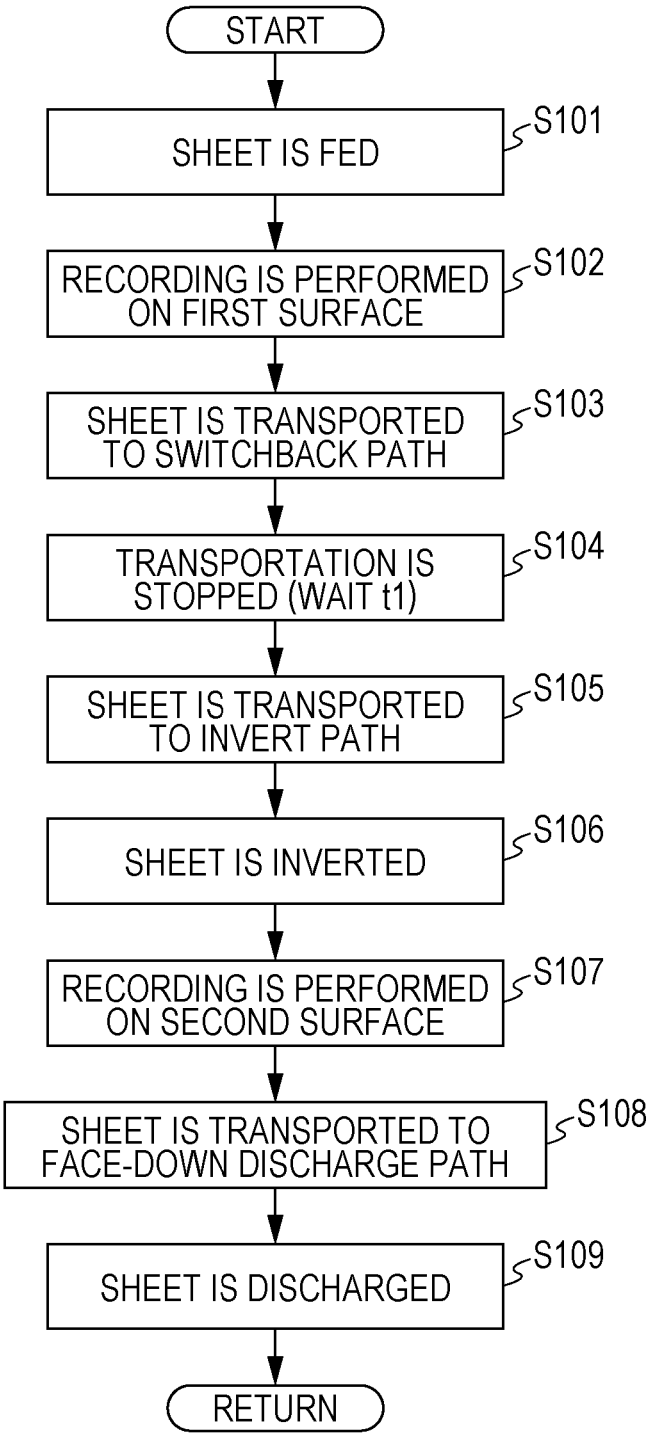
FIG. 13 is a flowchart illustrating control when recording is performed on both surfaces.

In addition, if a paper jam occurs in the switchback path R2 or the face-down discharge path R4, it is possible to easily perform a jam processing operation by a path opening mechanism illustrated in FIG. 12. Reference numeral 34 in FIGS. 12 and 2 represents a transport unit, and the transport unit 34 is slidably provided with respect to the apparatus body 2A (FIG. 1). The transport unit 34 integrally includes a part of rollers and path forming members configuring the switchback path R2 and the face-down discharge path R4. If the transport unit 34 is drawn out as illustrated in FIG. 12 from a mounting state (FIG. 2), the switchback path R2 is largely opened and the face-down discharge path R4 is also in a state of being separated in the middle thereof. Thus, even if the paper jam occurs in the switchback path R2 or the face-down discharge path R4, it is possible to easily perform the jam processing operation.

In addition, the ink jet recording head 8 in the embodiment is the recording head that is provided such that the nozzles ejecting the ink cover an entire region in the sheet width direction and is configured of the recording head capable of performing recording on an entirety of the sheet width because of not moving in the sheet width direction, but the ink jet recording head 8 may be configured as a recording head capable of performing the recording on the entirety in the sheet width with movement in the sheet width direction.

Furthermore, the face-down discharge path R4 (fourth transport path) may not necessarily be formed along the switchback path (second transport path).

The entire disclosure of Japanese Patent Application No.: 2014-065576, filed Mar. 27, 2014 is expressly incorporated by reference herein.

What is claimed is:

1. A recording apparatus comprising:

a medium storage section that stores a medium;

a first transport path that transports the medium that is fed from the medium storage section, passes through a recording section performing recording on the medium, and extends on an upstream side and a downstream side of the recording section;

a second transport path that is connected to the first transport path and transports the medium in a reverse direction of a transporting direction by switching back the medium after transporting the medium that has passed through the recording section;

a third transport path that is connected to the second transport path, inverts the medium that is transported in the reverse direction, and makes the medium be confluent with the first transport path at a position on the upstream side of the recording section, wherein the third transport path goes around an upper end of the recording section; and a fourth transport path that is connected to the first transport path, bends the medium that has passed through the recording section, and discharges the medium by inverting the medium, wherein the second transport path includes a curved path, the second transport path transporting the medium in a state where a first surface of the medium that has been recorded on by a recording head configuring the recording section faces to a curving direction of the curved path during at least a portion of the time the medium is being transported on the second transport path, and the second transport path is formed on a curved inside of the fourth transport path.

2. The recording apparatus according to claim 1, wherein the second transport path and the fourth transport path are configured such that the medium protruding from the second transport path and the medium discharged from the fourth transport path overlap in a horizontal direction, and wherein a state where a first medium is discharged from the fourth transport path and a state where a second medium following the first medium protrudes from the second transport path are controlled so as not to be formed simultaneously.

3. The recording apparatus according to claim 2, further comprising a second transport path member that comprises the second transport path; and a fourth transport path member that comprises the fourth transport path, wherein the second transport path member has a roller for transporting the medium, wherein the fourth transport path member has a roller for transporting the medium, wherein the second transport path member and the fourth transport path member are configured to be displaced between a mounting state in which the second transport path member and the fourth transport path member are adjacent to each other and a separation state in which the second transport path member and the fourth transport path member are separated from each other.

4. An ink jet recording apparatus comprising:

a medium storage section that stores a medium;

a recording section that is configured to record on the medium, includes an ink jet recording head;

a first transport path that transports the medium that is fed from the medium storage section, passes through the recording section, and extends on an upstream side and a downstream side of a recording section;

a second transport path that is connected to the first transport path and transports the medium in a reverse direction of a transporting direction by switching back the medium after transporting the medium that has passed through the recording section;

a third transport path that is connected to the second transport path, inverts the medium that is transported in the reverse direction, and makes the medium be confluent with the first transport path at a position on the upstream side of the recording section, wherein the third transport path goes around an upper end of the recording section; and a fourth transport path that is connected to the first transport path, and discharges the medium, wherein the fourth transport path includes a curved path so that the first surface of the medium opposed to the ink jet recording head in the first transport path from which the medium is sent immediately before the fourth transport path is made downward, and is discharged, wherein the second transport path includes a curved path that curves the same curving direction as the curving direction of the curved path of the fourth transport path.

5. The ink jet recording apparatus according to claim 4, further comprises a control section that controls the medium.

6. The ink jet recording apparatus according to claim 5, wherein when a first medium that is fed from the medium storage section is transported to the second transport path through the first transport path, a second medium is fed from the medium storage section.

7. The ink jet recording apparatus according to claim 6, wherein when the first medium is transported from the second transport path to the third transport path, the second medium is transported to the second transport path through the first transport path.

8. The ink jet recording apparatus according to claim 7, wherein when the first medium is transported from the third transport path to the first transport path, a third medium is fed from the medium storage section.

9. The ink jet recording apparatus according to claim 8, wherein when the first medium is transported from the first transport path to the fourth transport path, the second medium is transported from the second transport path to the third transport path, and the third medium is transported to the second transport path through the first transport path.

10. The ink jet recording apparatus according to claim 4, wherein a second transport path side portion of the third transport path includes a curved path that curves the same curving direction as the curving direction of the curved path of the second transport path, wherein a curvature of the curved path of the third transport path is greater than a curvature of the curved path of the second transport path.

11. The ink jet recording apparatus according to claim 4, wherein the control section controls the waiting time for the medium in the second transport path, when a ratio of covering the ink per unit area of a surface of a first medium is higher than a ratio of covering the ink per unit area of a surface of a surface of a second medium, the control section makes the waiting time of the first medium be longer than the waiting time of the second medium.

12. The ink jet recording apparatus according to claim 4 further comprises a roller that is arranged on an outer periphery of the curved path of the second transport path, and has a plurality of teeth on an outer periphery.

13. An ink jet recording apparatus comprising:

an apparatus body;

a medium storage section that is provided in the apparatus body, and stores a medium;

a recording section that is provided in the apparatus body, and is configured to record on the medium, includes an ink jet recording head; and a transport path that is provided in the apparatus body, and transports the medium that is fed from the medium storage section, the transport path comprising:

a first transport path that passes through the recording section, and extends on an upstream side and a downstream side of a recording section;

a second transport path that is connected to the first transport path and transports the medium in a reverse direction of a transporting direction by switching back the medium after transporting the medium that has passed through the recording section;

a third transport path that is connected to the second transport path, inverts the medium that is transported in the reverse direction, and makes the medium be confluent with the first transport path at a position on the upstream side of the recording section; and a fourth transport path that is connected to the first transport path, and discharges the medium from the apparatus body, wherein the fourth transport path includes a curved path so that the first surface of the medium opposed to the ink jet recording head in the first transport path from which the medium is sent immediately before the fourth transport path is made downward, and is discharged, wherein the second transport path includes a curved path that curves in the same curving direction as the curving direction of the curved path of the fourth transport path, further comprising:

a transport unit that is movable to the apparatus body, and has the fourth transport path, wherein the second transport path includes a first portion that is provided with the transport unit and a second portion that is provided with the apparatus body, wherein when the transport unit moves off the apparatus body, the first portion and the second portion of the second transport path are separated from each other.

14. The ink jet recording apparatus according to claim 13, wherein the second transport path has an opening, the opening is positioned below a discharge port of the fourth transport path, wherein a part of the medium protrudes outside of the apparatus body through the opening.

15. The ink jet recording apparatus according to claim 14, further comprises a control section that controls the medium, the control section controls such that a state where the medium is protruded from the opening and a state that the medium is protruded from the discharge port are not generated simultaneously.

* * * * *